US011203031B2

(12) United States Patent
Albrecht

(10) Patent No.: US 11,203,031 B2
(45) Date of Patent: Dec. 21, 2021

(54) PORTABLE AND REPOSITIONABLE DEPOSITION MATERIAL APPLICATOR ENCLOSURE AND APPLICATION SYSTEM FOR APPLYING DEPOSITION MATERIAL ON A SUBSTRATE EMPLOYING NON-ADHERENT DEPOSITION MATERIAL WASTE REMOVAL AND SELECTIVE ENCLOSURE COUPLING AND DECOUPLING STRUCTURES OR SYSTEMS EMPLOYING A PLURALITY OF SELECTIVE COUPLING FORCES

(71) Applicant: The United States of America, as represented by the Secretary of the Navy, Crane, IN (US)

(72) Inventor: John William Albrecht, Silverdale, WA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 3 days.

(21) Appl. No.: 16/506,086

(22) Filed: Jul. 9, 2019

(65) Prior Publication Data

US 2020/0009593 A1 Jan. 9, 2020

Related U.S. Application Data

(60) Provisional application No. 62/695,556, filed on Jul. 9, 2018.

(51) Int. Cl.

| | |
|---|---|
| ***B05B 14/30*** | (2018.01) |
| ***B05C 11/10*** | (2006.01) |
| ***B05D 1/12*** | (2006.01) |
| ***B05D 1/06*** | (2006.01) |

(52) U.S. Cl.

CPC ..... *B05B 14/30* (2018.02); *B05C 11/1039* (2013.01); *B05D 1/06* (2013.01); *B05D 1/12* (2013.01); *B05D 2401/32* (2013.01)

(58) Field of Classification Search

None

See application file for complete search history.

(56) References Cited

U.S. PATENT DOCUMENTS

2012/0186520 A1* 7/2012 Hill ..... B08B 3/026 118/713

* cited by examiner

*Primary Examiner* — James M Mellott

(74) *Attorney, Agent, or Firm* — Naval Surface Warfare Center, Crane Division; Eric VanWiltenburg

(57) ABSTRACT

Apparatuses and methods related to improving environmental protection and waste collection from application of deposition material using portable systems that are easier for operators to use on surfaces such as ship hulls are provided. Embodiments include a portable and repositionable deposition material applicator enclosure and application system for applying deposition material on a substrate employing non-adherent deposition material waste removal and selective enclosure coupling and decoupling structures or systems employing magnetic and suction or differential pressure based forces.

8 Claims, 3 Drawing Sheets

PORTABLE AND REPOSITIONABLE DEPOSITION MATERIAL APPLICATOR ENCLOSURE AND APPLICATION SYSTEM FOR APPLYING DEPOSITION MATERIAL ON A SUBSTRATE EMPLOYING NON-ADHERENT DEPOSITION MATERIAL WASTE REMOVAL AND SELECTIVE ENCLOSURE COUPLING AND DECOUPLING STRUCTURES OR SYSTEMS EMPLOYING A PLURALITY OF SELECTIVE COUPLING FORCES

CROSS-REFERENCE TO RELATED APPLICATION

This application claims priority to U.S. Provisional Application Ser. No. 62/695,556 filed on Jul. 9, 2018, the disclosure of which is expressly incorporated herein by reference

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,535) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to systems and methods for moving, coupling with, enclosing, and applying a deposition material on a substrate using a moveable structure that enables ease of movement of a moveable enclosure that surrounds a selected section of the substrate while enabling removal of non-adherent deposition material from within the enclosure to a waste collection system. In particular, embodiments of the invention include portable and repositionable deposition material applicator enclosure and application system for applying deposition material on a substrate employing non-adherent deposition material waste removal and selective enclosure coupling and decoupling structures or systems employing magnetic and suction or differential pressure based forces.

Embodiments of the invention can include embodiments that encloses the volume between the applicator of a cold spray deposition system and the metal substrate upon which the powder is being deposited. The primary specific benefits of this invention are that (a) it allows a large, relatively flat surface to be coated without the need to unfasten and refasten the edges of a glove box, and (b) it enables the deposition to be done in an enclosed area no larger than a human torso.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
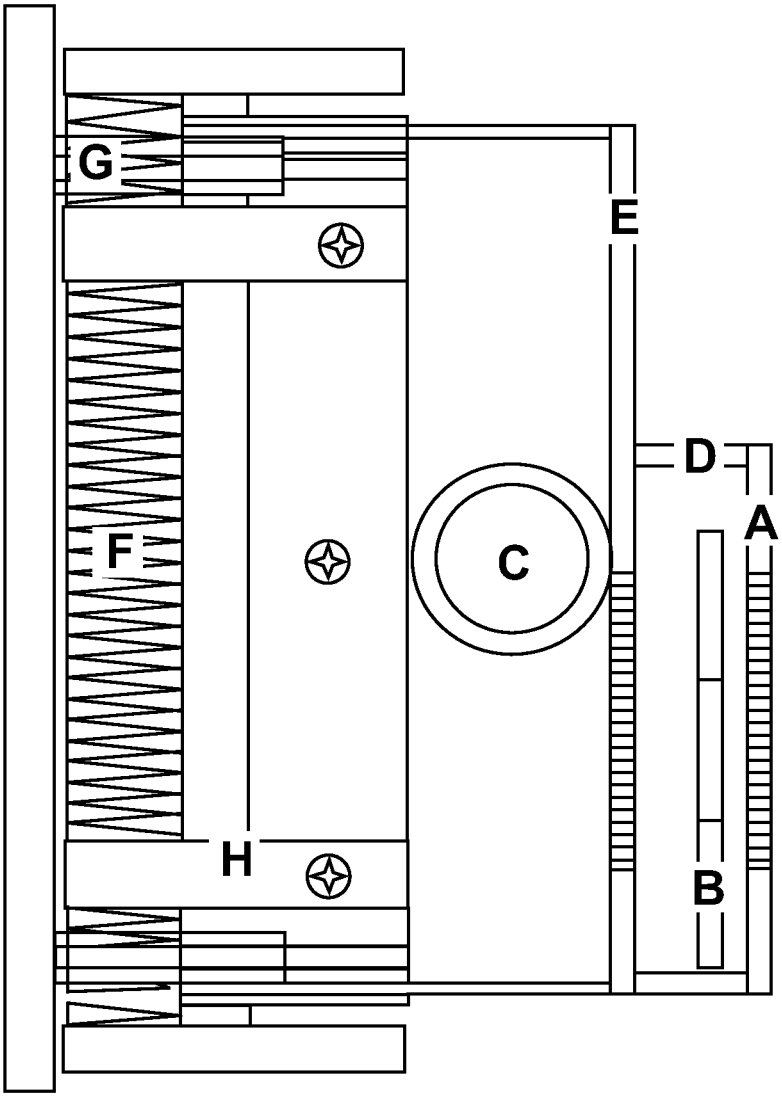
FIG. 1 shows a side view of an embodiment of the invention.
Figure 2:
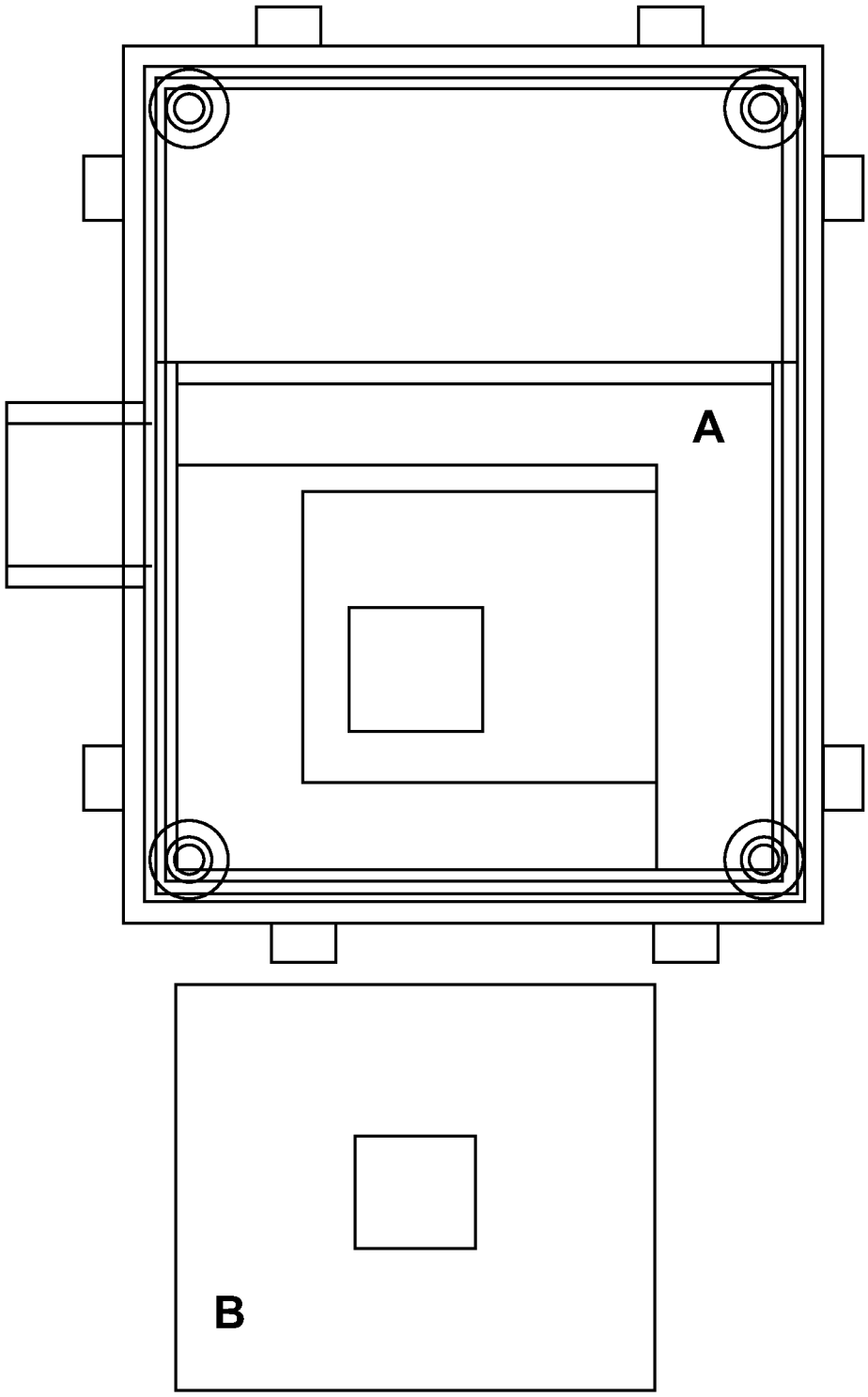
FIG. 2 show a user facing view of the FIG. 1 embodiment of the invention.
Figure 3:
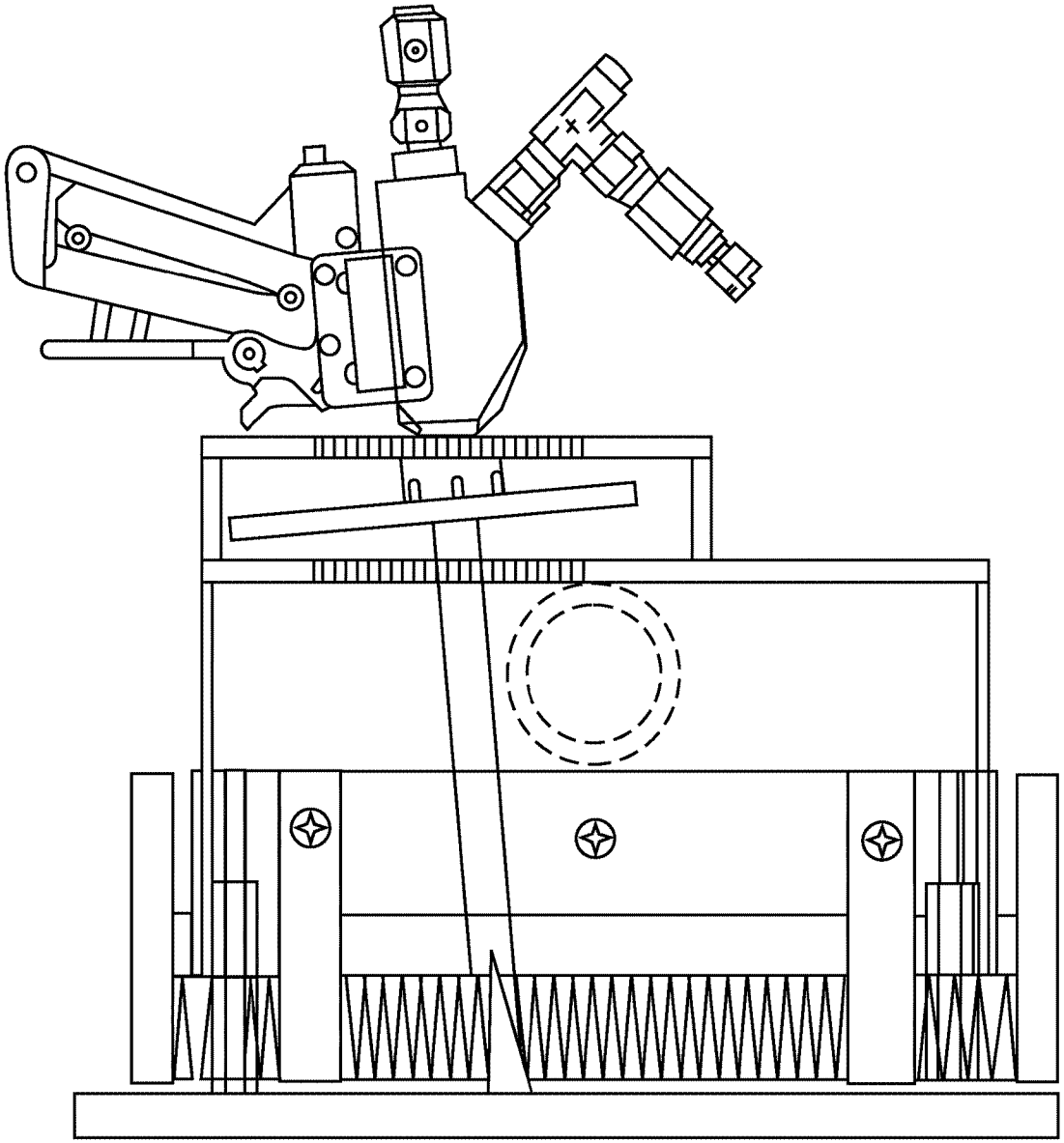
FIG. 3 shows another side view of the FIGS. 1 and 2 embodiment of the invention.

Referring to FIGS. 1, 2, and 3, an embodiment of the invention can include a structure or enclosure where a body of the applicator enclosure is attached at the edges of the hole in a top plate A to a freely mobile enclosed plate B, which is constrained by View Plate E and an upper enclosure D and the Top Plate A. A vacuum capability can be created by suction at port C that reduces pressure inside the enclosure (e.g., an area enclosed by the walls, View Plate, and substrate). Atmospheric pressure against the View Plate E and Top Plate A forces the deposition enclosure assembly to be pressed against the substrate. Seals or brushes F can contribute to adjustably control an amount of air drawn into the enclosure when moved closer or farther away from the substrate. Standoffs G can be provided to prevent the enclosure assembly from crushing the seals or brushes E. Magnets can be provided, including a variety of magnets, selectively adjustable magnets, electromagnets, etc that provide additional force to pull the enclosure against the substrate.

During operation of this embodiment, atmospheric pressure external to the enclosure assembly forces the interior plate B against the top surface of View Plate E. This brings the seals or brushes F nearer to the substrate, thereby increasing a force against the substrate from the seals or brushes which further produce friction from the feet G which collectively offsets a force of gravity on the enclosure. A distance by which legs or extensions of standoffs (e.g., screw jacks, etc) G extend from the main enclosure can further determines a gap between the seals or brushes F and the substrate further controlling an amount of air drawn into the main enclosure. When the applicator mounted to the enclosure, e.g., top plate A is moved to direct a deposition jet to a desired location on the substrate, the interior plate slides freely against the top surface of the main enclosure, View Plate E. The applicator can be easily tilted to provide deposition in most portions of the substrate covered or enclosed by the enclosure, which is easily visible through View Plate E (because the operator's viewpoint is located above View Plate E). When the applicator is tilted significantly or beyond a predetermined limit or distance, such movement creates a gap between the interior plate B and the hole in the main enclosure adjacent to View Port E; reducing the suction within the enclosure and allowing the deposition enclosure to be moved to another location on the substrate.

During all these operations and movements, the suction provided at C by the external vacuum source provides a net inflow into the interior of the main enclosure. This prevents any non-adherent deposition materials from escaping from the interior of the main enclosure to the exterior of the enclosure. Because the suction volume at C is significantly larger than the deposition gas inflow entering the deposition chamber through the hole at A at all times, there is a net inflow of air into the deposition chamber at all times. This ensures that all non-adherent deposition particles are captured in the deposition chamber and removed into the vacuum source via suction port C. An alternative embodiment can provide for a vacuum control or suction control on the enclosure which allows an operator to alter suction forces within the enclosure and thereby adjust suction force to increase or decrease coupling or differential pressure coupling effect between the enclosure and the substrate and thereby allow movement of the enclosure by the operator. Such controls can be a port, a switch, etc. Alternative embodiments can also control the external vacuum source to increase or reduce vacuum supplied to the enclosure.

Magnets H are shown affixed to the walls, to increase the adherence to the substrate. In at least some embodiments, disposition and magnetic coupling power of the magnets ensure that at least a partial seal or adherence to the substrate is created at all times. Exemplary embodiments of the magnets can provide a first coupling or magnetic attachment effect which is less than an additional coupling or adherence effect produced from suction from the external vacuum source such that movement of the enclosure is easier or requires less force from an operator when the suction force is reduced as described above. In other words, in at least some embodiments, the magnetic adherence is sufficient to maintain adherence of the enclosure to the substrate so it can be moved. In at least some embodiments, magnets can be selectively positioned to add or subtract magnetic coupling or adherence of the enclosure with the substrate. Alternative embodiments can also include use of electromagnetic systems which can selectively increase or decrease magnetic attraction and attachment of the enclosure with the substrate via an operator control which can be located on the enclosure in proximity with a material applicator such as a spray control.

Although specifically intended for use with cold spray deposition applications, this concept is applicable to all cases where the deposition materials are desired to be collected and prevented from entering the general environment. Such applications would include thermal spray, painting, and the application of various substances (e.g., hazardous materials, chemical agents, etc.).

A method of operating is also provided. Step 101: providing the moveable material deposition and waste controls system such as described herein. Step 103: disposing the moveable material deposition and waste control system on the surface or substrate, adjusting the stand-off structures to adjust relative positon of the enclosure with the substrate or surface. Step 105: operating the selective coupling structures to selectively couple the enclosure with the substrate or surface. Step 107: operating the material application system to and the material applicator to commence applying the deposition material within the enclosure onto the surface or substrate. Step 109: removing the particulate or waste created by the applications system from within the enclosure using at least the waste removal system. Step 111: operating the moveable adjustment structure to reduce at least one of the plurality of coupling forces produced by at least a portion of the selective coupling structures Step 113: reposition the enclosure then operate the moveable adjustment structure to increase at least one of the plurality of coupling forces produced by at least a portion of the selective coupling structures and thereby couple the enclosure to the surface or substrate. Step 115: repeating the operating the material application system and removing the particulate or waste step at least once.

Although the invention has been described in detail with reference to certain preferred embodiments, variations and modifications exist within the spirit and scope of the invention as described and defined in the following claims.

The invention claimed is:

1. A method of operating a moveable material deposition and waste control system comprising:

providing a moveable material deposition and waste control system comprising:

a portable and repositionable deposition material applicator enclosure comprising:

a selective coupling structures that selectively and adjustably couples the enclosure with a substrate or surface with at least a first and second selective coupling systems by creating a plurality of adjustable coupling forces which couples the enclosure with the substrate or surface;

a sealing system comprising brushes coupled with edge or interface sections of the enclosure that selectively seals the edges or interface sections of the enclosure with the substrate or surface;

a viewing system comprising a view plate that enables viewing of the substrate or surface within the enclosure;

an adjustable standoff system comprising screw jacks coupled with the enclosure that adjusts relative position of the edges or interface sections of the enclosure and thereby selectively adjusts seal compression or sealing produced by the sealing system with the substrate or surface; and a material application system interface section, wherein the material application interface section further includes a coupling force adjustment section that selectively adjusts at least one of the plurality of coupling forces created by at least one of the selective coupling structures that comprises a moveable adjustment structure that the operator moves or operates to reduce or increase at least one of the plurality of coupling forces produced by at least a portion of the selective coupling structures;

a material application system comprising a material applicator section that selectively applies deposition material on a selected section of the substrate or surface surrounded by the enclosure, wherein the material applicator section is sealably and moveably coupled with and passes through the material application system interface section, wherein the viewing system is formed with a viewing section that enables an operator to view the material applicator section positioning and material deposition emission path within the enclosure so that an operator can view application of deposition material onto the substrate or surface through the viewing section; and a waste removal system comprising a power source, collection system, and a connection system coupled with at least one waste removal manifold or port section of at least a portion of the coupling structures that facilitates removal of particulate or waste created by the applications system when it is applying deposition material to the substrate or surface within the enclosure, wherein the waste removal system is also coupled with one or more sections of the selective coupling structures to supply at least a portion of a source creating or contributing to the plurality of adjustable coupling forces;

disposing the moveable material deposition and waste control system on the surface or substrate, adjusting the stand-off structures to adjust relative positon of the enclosure with the substrate or surface;

operating the selective coupling structures to selectively couple the enclosure with the substrate or surface, wherein atmospheric pressure external to the enclosure forces an interior plate against the view plate to bring the brushes nearer to the substrate, thereby increasing force against the substrate from the brushes, which further produce friction from feet and offsets gravitational forces on the enclosure, adjusting a distance by which the screw jacks extend from the enclosure to further determine a gap between the brushes and the substrate to further control an amount of air drawn into the enclosure;

operating the material application system to and the material applicator to commence applying the deposition material within the enclosure onto the surface or substrate;

removing the particulate or waste created by the applications system from within the enclosure using at least the waste removal system;

operating the moveable adjustment structure to reduce at least one of the plurality of coupling forces produced by at least a portion of the selective coupling structures;

reposition the enclosure then operate the moveable adjustment structure to increase at least one of the plurality of coupling forces produced by at least a portion of the selective coupling structures and thereby couple the enclosure to the surface or substrate; and repeat the operating the material application system and removing the particulate or waste step at least once.

2. A method as in claim 1, wherein the waste removal system further comprises a manifold and gas or air routing system which generates gas or air flows within the enclosure to route said particulate or waste out of the enclosure with a predetermined one or more paths.

3. A method as in claim 1, wherein the material application interface section is formed or coupled with a section of the enclosure.

4. A method as in claim 1, wherein the first and second selective coupling systems respectively comprise a magnetic and suction or differential pressure based system, wherein the first selective coupling system comprises a plurality of magnetic structures coupled with and the enclosure, wherein the waste removal system generates the suction while a cooperative operation of the suction or differential pressure based system and the coupling force adjustment section creates a differential pressure or suction force which increases or reduces the differential pressure or section force and thereby creates or reduces at least one of the coupling forces.

5. A method as in claim 1, wherein the brushes are coupled with edges of the enclosure surrounding an interior space.

6. A method as in claim 1, wherein the adjustable standoff system comprises a plurality of stand-off structures coupled with the enclosure that selectively adjusts stand-off distance from the edges of the enclosure facing the surface or substrate or degree of compression of the brushes and the substrate or surface the seal structures brushes contacts when the enclosure is selectively coupled with the substrate.

7. A method as in claim 1, wherein the viewing structure comprises a view port formed into a first side of the enclosure that is adjacent to lateral sides of the stand-off structures, wherein the at least one waste removal manifold or port further comprises a vacuum port formed into the enclosure.

8. A method as in claim 1, wherein the differential pressure or suction based system comprises a vacuum source that is coupled with the vacuum port.

* * * * *